United States Patent [19]

Krishnamurthy

[11] Patent Number: 4,540,657

[45] Date of Patent: Sep. 10, 1985

[54] PHOTOGRAPHIC COUPLER SOLVENTS AND PHOTOGRAPHIC ELEMENTS EMPLOYING SAME

[75] Inventor: Sundaram Krishnamurthy, Penfield, N.Y.

[73] Assignee: Eastman Kodak Company, Rochester, N.Y.

[21] Appl. No.: 617,782

[22] Filed: Jun. 6, 1984

[51] Int. Cl.[3] ..... G03C 7/26

[52] U.S. Cl. ..... 430/546; 430/377; 430/554

[58] Field of Search ..... 430/546, 377, 624, 554

[56] References Cited

U.S. PATENT DOCUMENTS

| | | | |
|---|---|---|---|
| 3,729,318 | 4/1973 | Himmelmann et al. | 430/624 |
| 3,989,529 | 11/1976 | Viro et al. | 430/546 |
| 4,239,851 | 12/1980 | Aoki et al. . | |
| 4,252,894 | 2/1981 | Viro et al. | 430/546 |
| 4,368,258 | 1/1983 | Fujiwhara et al. | 430/546 |

*Primary Examiner*—J. Travis Brown

*Attorney, Agent, or Firm*—Harold E. Cole

[57] ABSTRACT

Photographic coupler solvents having at least one terminal epoxy group and at least one ester or amide group are described for incorporation in photographic emulsions and elements. The solvents are preferably employed in the magenta layer to reduce background stain produced by exposure to light, heat and humidity.

12 Claims, No Drawings

PHOTOGRAPHIC COUPLER SOLVENTS AND PHOTOGRAPHIC ELEMENTS EMPLOYING SAME

This invention relates to photographic coupler solvents and to silver halide photographic elements employing such coupler solvents. In a particular aspect, it relates to coupler solvents containing at least one terminal epoxy group and at least one ester or amide group.

Images are commonly obtained in the photographic art by a coupling reaction between the development product of a silver halide color developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent silver halide layers sensitive to radiation complementary to the radiation absorbed by the image dye; i.e. silver halide emulsions sensitive to red, green and blue radiation.

The patent and technical literature is replete with references to compounds which can be used as couplers for the formation of photographic images. Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531, 3,041,236 and "Farbkuppler-eine Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067, 2,908,573 and "Farbkuppler-eine Literaturubersicht," published in Agfa Mitteilungen, Band II, pp. 126–156 (1961).

Couplers which form yellow dyes upon reaction with oxidized color developing agent are acylacetanilides such as benzoylacetanilides and pivalylacetanilides. Representative couplers are described in the following patents and publications: U.S. Pat. Nos. 2,875,057, 2,407,210, 3,265,506, 2,298,443, 3,048,194, 3,447,928 and "Farbkuppler-eine Literaturubersicht," published in Agfa Mitteilungen, Band II, pp. 112–126 (1961).

When intended for incorporation in photographic elements, couplers are commonly dispersed therein with the aid of a high boiling organic solvent, referred to as a coupler solvent. Couplers are rendered nondiffusible in photographic elements, and compatible with coupler solvents, by including in the coupler molecule a group referred to as a ballast group. This group is located on the coupler in a position other than the coupling position and imparts to the coupler sufficient bulk to render the coupler nondiffusible in the element as coated and during processing. It will be appreciated that the size and nature of the ballast group will depend upon the bulk of the unballasted coupler and the presence of other substituents on the coupler.

The high boiling solvents of phthalic ester compounds, e.g. dibutyl phthalate, and phosphoric ester compounds, e.g., tricresyl phosphate, have often been used as coupler solvents because of their coupler-dispersing ability, inexpensiveness and availability. Such compounds are described in Jelley et al, U.S. Pat. No. 2,322,027. However, the conventional coupler solvents provide dye images which may exhibit a tendency to form background stain upon exposure to light, heat and humidity. The problem is even more severe for some of the newer magenta couplers which have increased activity.

U.S. Pat. No. 4,239,851 relates to cyan couplers which are dissolved in certain epoxy compounds having a particular formula. Such compounds do not have both a terminal epoxy group and an ester or amide group as do the compounds described herein. As will be shown by comparative data hereafter, the compounds of the invention have substantially improved properties as compared to the closest related epoxy compound of this patent. These improved properties include a considerable lessening of yellow stain formation on high humidity keeping, limiting stain on exposure to heat or light, and a resistance to heat fading of the image dye.

It would be desirable to provide a new class of coupler solvents useful in color photographic materials, particularly those having magenta couplers. It would also be desirable to provide such solvents which markedly reduced undesirable staining effects formed on exposure to heat, light and high humidity, as compared to coupler solvents of the prior art, and which also provide improved stability of the dye image. These properties would be particularly advantageous in color print materials, since users find even slight amounts of stain objectionable.

These and other objects are achieved in accordance with the invention which comprises a photographic element comprising a support having thereon at least one silver halide emulsion layer having associated therewith a dye-forming coupler and a coupler solvent therefor which has at least one terminal epoxy group and at least one ester or amide group.

The expression "terminal epoxy group" means that the compound has an appendage, either in the middle or at the end, which contains a group having the formula

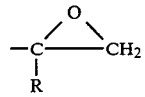

wherein R is defined hereinafter.

In a preferred embodiment of the invention the coupler solvents have the formula I.

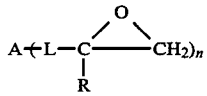

wherein

A is a polyvalent atom such as oxygen, nitrogen, sulfur, boron, carbon, phosphorus or silicon;

an acidic oxide group such as

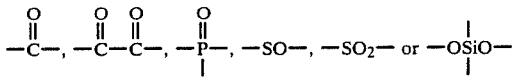

a carbocyclic group such as benzene, naphthalene, cyclohexane, cyclopentane, cycloheptane or cyclooctane;

a heterocyclic moiety such as pyridine, pyridine oxide, furan, thiophene, pyrazole, triazine, quinoline, pyran,

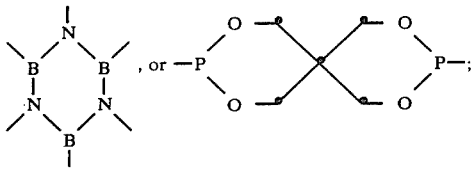

an alkane or substituted alkane group such as $\leftarrow CH_2 \rightarrow_m$ where m is 1 to about 6,

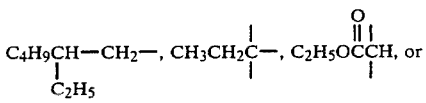

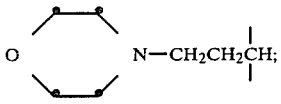

or a polymeric backbone of a vinyl polymer such as an acrylate, an acrylamide, or a styrene, such as those disclosed in Item No. 19551, July, 1980 *Research Disclosure*, pages 301–310;

each L is at least one divalent linking group such as $\leftarrow CH_2 \rightarrow_p$ (p = 1 to about 9), —O—, —NH—,

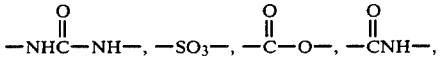

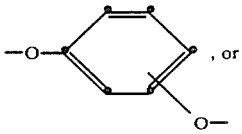

, or carboxylic esters such as 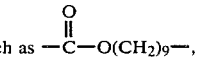

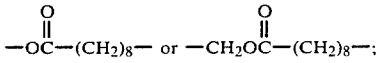

each R is H, alkyl of 1 to about 10 carbon atoms, cycloalkyl such as cyclohexyl, cyclopentyl or cycloheptyl; aryl such as phenyl, tolyl, or naphthyl; heterocycyl such as pyridyl, thienyl, or furyl; $COOR^1$ wherein $R^1$ is alkyl of 1 to about 20 carbon atoms, or can be taken together with A or L to form a ring such as

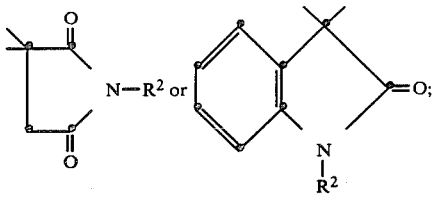

$R^2$ may be hydrogen, alkyl of 1 to about 10 carbon atoms, aryl such as phenyl, tolyl or naphthyl; or heterocyclyl such as pyridyl, thienyl or furyl; and n is a positive integer of at least one, preferably from 2–4, with the proviso that at least one A, L or R contains at least one ester or amide group derived from an acidic oxide of carbon, phosphorous, sulfur, boron or silicon, such as

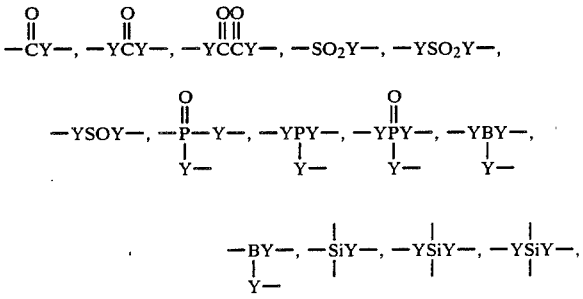

and the like, where Y may be O or $NR^2$. Each of A, L or R may also be further substituted if desired.

In a preferred embodiment of the invention, the dye-forming coupler associated with the silver halide emulsion described above forms a magenta dye upon reaction with oxidized color developing agent, and the coupler and coupler solvent are located in the silver halide emulsion layer.

In another preferred embodiment of the invention, the coupler solvent has the formula II.

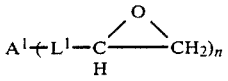

wherein $A^1$ is an alkane or substituted alkane group or a carbocyclic group, $L^1$ is a carboxylic ester, and n is a positive integer of at least one.

Preferred compounds included within the scope of the invention include the following:

1. 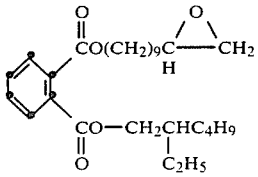

-continued
2.
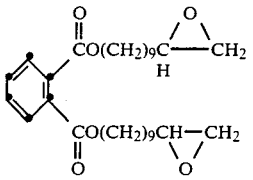
3.
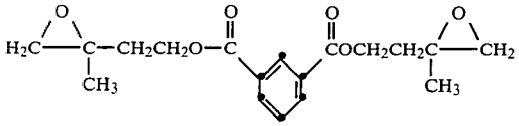
4.
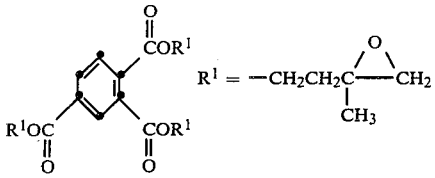
5.
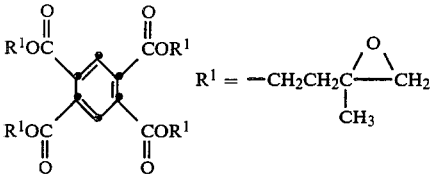
6.
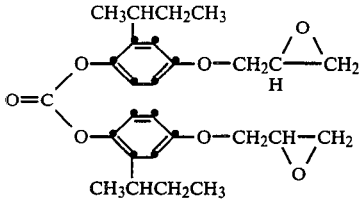
7.
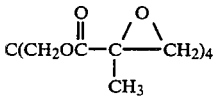
8.
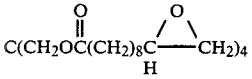
9.
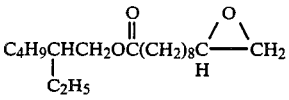
10.
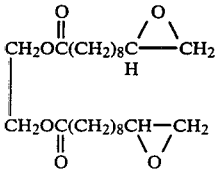
-continued
11.
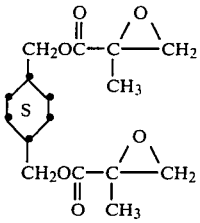
12–15.
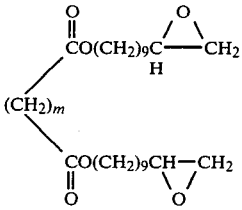
12. m = 0
13. m = 1
14. m = 2
15. m = 3
16.
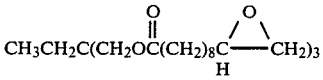
17.
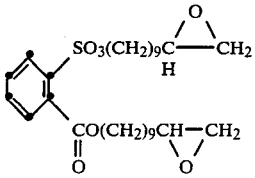
18.
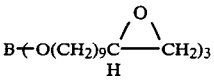
19.
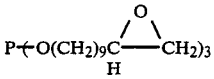
20.
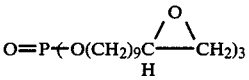
21.
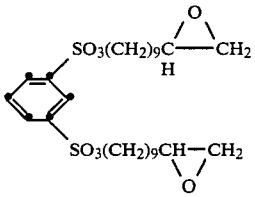
22.
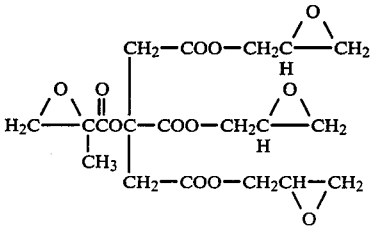

-continued
23.
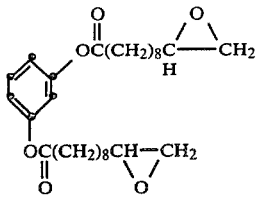
24.
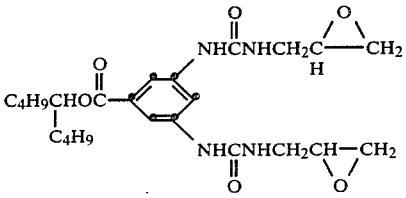
25.
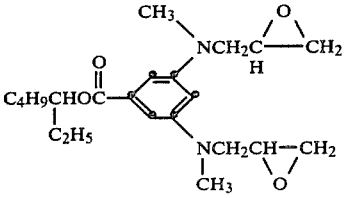
26.
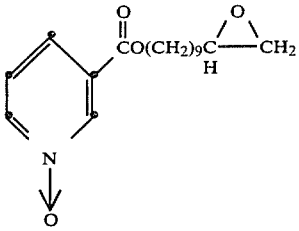
27.
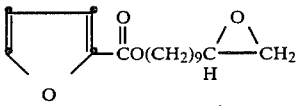
28.
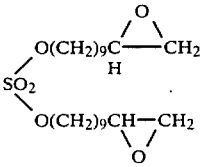
29.
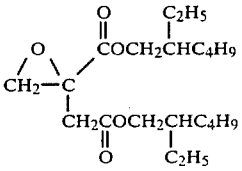
30.
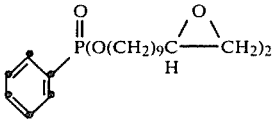
-continued
31.
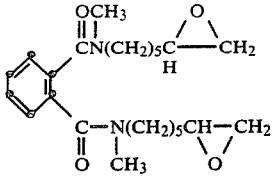
32.
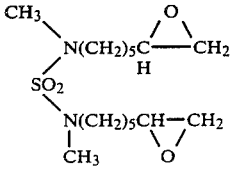
33.
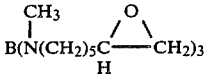
34.
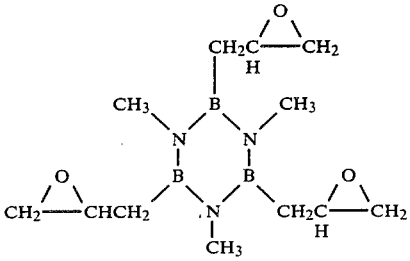
35.
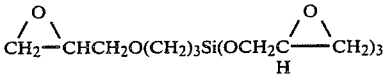
36.
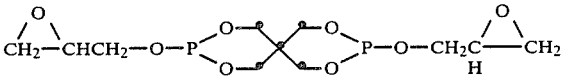
37.
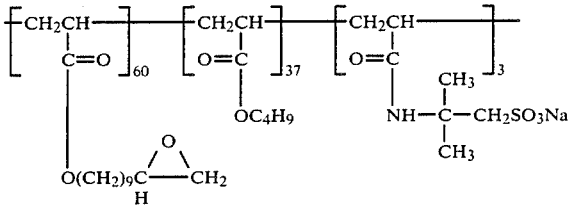
38.
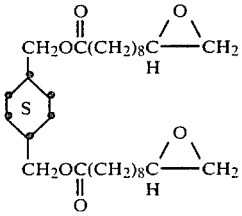

-continued

39.

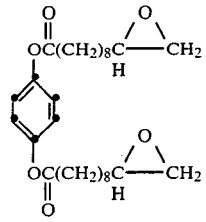

40.

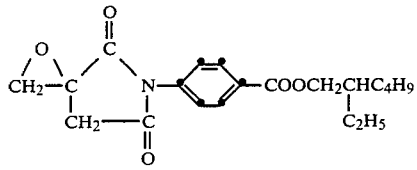

The above compounds may be synthesized by forming the ester (or amide) from the corresponding acid chloride and an alcohol (or amine) so that the product contains one or more terminal vinyl groups. Each terminal vinyl group is then oxidized to the corresponding epoxide.

The coupler solvents of this invention can be used in the ways and for the purposes that coupler solvents are used in the photographic art.

Typically, the coupler solvent and coupler are incorporated in a silver halide emulsion and the emulsion coated on a support to form a photographic element. Alternatively, the coupler solvent and coupler can be incorporated in photographic elements adjacent the silver halide emulsion wherein, during development, the coupler will be in reactive association with development products such as oxidized color developing agent. Thus, as used herein, the term "associated therewith" signifies that the coupler solvent and coupler are in the silver halide emulsion layer or in an adjacent location where, during processing, they will come into reactive association with silver halide development products.

Photographic elements of the invention can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

A typical multicolor photographic element of the invention would comprise a support having thereon a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the couplers in the element being dissolved in a coupler solvent of this invention. The element can contain additional layers, such as filter layers, interlayers, overcoat layers, subbing layers, and the like.

In the following discussion of suitable materials for use in the emulsions and elements of this invention, reference will be made to *Research Disclosure,* December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Resarch Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-$\beta$-(methanesulfonamido) ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethyl-aniline hydrochloride and 4-amino-N-ethyl-N-(2-methoxy ethyl)-m-toluidine di-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

EXAMPLE 1

Preparation of Compound 2

A 50.76 g (0.25 mol) portion of phthaloyl chloride (A) was added dropwise under nitrogen to ice cold 93.67 g (0.55 mol) 10-undecen-1-ol (B). Stirring was continued one hour and the mixture was then heated to reflux 45 minutes. Chromatography and distillation gave 58 g pure ester C, b.p. 210° C. (0.5 mm).

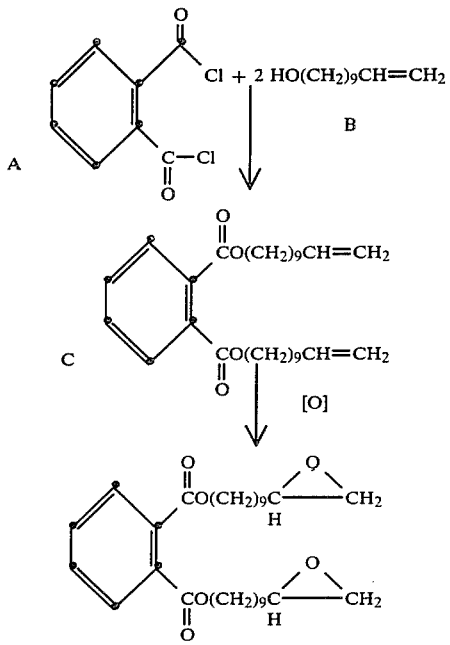

Compound 2

To a stirred, ice cold solution of 16 g (0.034 mol) C in 70 ml dichloromethane was added dropwise a solution of 14.24 g (0.072 mol) m-chloroperbenzoic acid in 130 ml dichloromethane. After one hour, the mixture was washed with a 10% sodium sulfite solution, then with saturated salt solution, dried, and purified by chromatography to give 10.7 g of compound 2.

EXAMPLE 2

Preparation of Compound 9, 2-Ethylhexyl 10,11-Epoxyundecanoate

To a stirred solution of 32.56 g (0.25 mol) 2-ethylhexanol in 100 ml tetrahydrofuran under nitrogen was added slowly over 5 minutes 50.70 g (0.25 mol) 10-undecenoyl chloride (E). After 4 days the mixture was drowned with water, extracted with ethyl acetate, and the extracts washed and dried over magnesium sulfate. Solvent removal gave 70.3 g orange oil with an nmr spectrum consistent with ester F.

To an ice-cold stirred solution of 35 g (0.12 mol) ester F in 200 ml dichloromethane was added dropwise over 15 minutes and under nitrogen a solution of 40.73 g (0.24 mol) m-chloroperbenzoic acid in 450 ml dichloromethane. After 17 hours, 40 ml water was added dropwise under nitrogen. The mixture was then poured into 300 ml water and the separated organic layer washed with saturated sodium chloride and 10% sodium sulfite solutions then dried over magnesium sulfate. The solvent was removed and the product, redissolved in ethyl acetate, was treated one hour with 20% sodium bicarbonate solution, then washed and dried over magnesium sulfate. Purification by silica gel chromatography and solvent removal yielded a clear oil with an nmr spectrum consistent with expected compound 9.

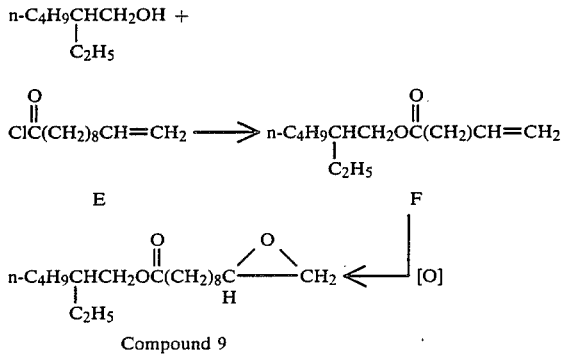

Compound 9

EXAMPLE 3

Preparation of Compound 10, 1,2-Bis(10,11-epoxyundecanoyloxy) ethane

In a procedure similar to that described in Example 2, 6.21 g (0.1 mol) ethylene glycol was converted to the diester G yielding 28 g orange oil after silica gel chromatography. Epoxidation and purification by silica gel chromatography yielded compound 10 as a light yellow waxy solid, m.p. 39°–40° C., having the expected nmr spectrum.

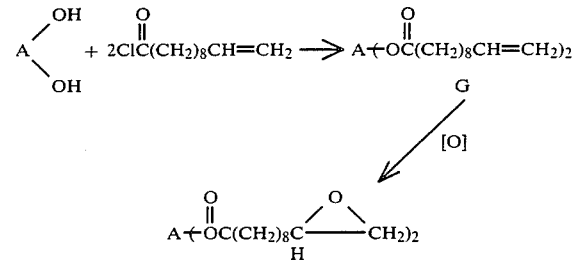

wherein A=—$CH_2CH_2$—. Compounds 38 and 39 can be prepared in the same manner as compound 10, wherein A=

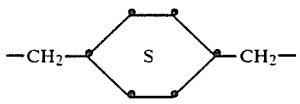

and

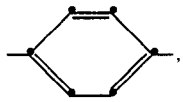

respectively.

EXAMPLE 4

Preparation of Compound 38, 1,4-Bis-(10,11-epoxyundecanoyloxymethyl)-cyclohexane Using the procedure described in Example 3, 21.63 g (0.15 mol) 1,4-cyclohexanedimethanol was esterified to yield 80.9 g orange oil G

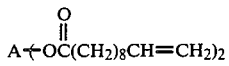

G where

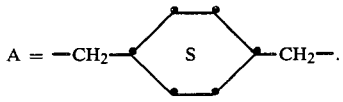

Epoxidation of 40 g G diester and purification yielded a light yellow oil having the nmr spectrum expected for compound 38.

EXAMPLE 5

Preparation of Compound 39, p-Phenylene Bis(10,11-epoxyundecanoate)

The procedure described in Example 3 was employed to convert 16.52 g (0.15 mol) hydroquinone to 34 g diester G

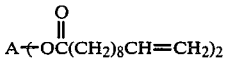

G where

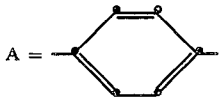

as a white solid, with the correct nmr spectrum after recrystallization from acetonitrile. Epoxidation of 18 g G yielded a white solid with a clearly defined nmr spectrum consistent with compound 39.

EXAMPLE 6

Magenta Monolayer Comparative Photographic Test

A photographic element was prepared by coating a paper support with a photosensitive layer containing a silver bromoiodide emulsion at 3.89 mmols Ag/m$^2$, gelatin at 1.615 g/m$^2$, and the magenta coupler, coupler solvent and chromanol stabilizer levels indicated in Table 1. The photosensitive layer was overcoated with a layer containing gelatin at 1.08 g/m$^2$ and bis-vinyl-sulfonylmethyl ether at 1.75 weight percent based on total gelatin.

Samples of each element were imagewise exposed through a graduated-density test object, processed at 33° C. employing the color developer identified below, then 1.5 minutes in the bleach-fix bath, washed and dried.

| Color Developer (pH 10.08) | |
|---|---|
| Triethanolamine | 11 ml |
| Benzyl alcohol | 14.2 ml |
| Lithium chloride | 2.1 g |
| Potassium bromide | 0.6 g |
| Hydroxylamine sulfate | 3.2 g |
| Potassium sulfite (45% solution) | 2.8 ml |
| 1-Hydroxyethylene-1,1-diphosphoric acid (60%) | 0.8 ml |
| 4-Amino-3-methyl-N—ethyl-N—β-methanesulfonamido)ethylaniline sulfate hydrate | 4.35 g |
| Potassium carbonate (anhydrous) | 28 g |
| Stilbene whitening agent | 0.6 g |
| Surfactant | 1 ml |
| Water to make | 1.0 liter |

| Bleach-Fix Bath (pH 6.8) | |
|---|---|
| Ammonium thiosulfate | 104 g |
| Sodium hydrogen sulfite | 13 g |
| Ferric Ammonium EDTA | 65.6 g |
| EDTA | 6.56 g |
| Ammonium hydroxide (28%) | 27.9 ml |
| Water to make | 1 liter |

The samples were then subjected to three different tests. The "dark fade" test conditions consisted of a "wet oven" (6 weeks at 60° C. and 70% R.H.) and a "dry oven" (2 weeks at 77° C., 15% R.H.). The "light fade" test conditions consisted of 24 weeks exposure to 5.4 Klux visible light. A Wratten 2B filter was used to screen ultraviolet component of incident light from the xenon source. Measurements were made of increases in yellow stain ($\Delta D_{min}$ to blue light) and of changes in a magenta D=1.0 patch ($\Delta D_{max}$ to green light). The following results were obtained:

TABLE 1

| | Magenta Coupler (mg/m$^2$) | Coupler Solvent* | Dark Fade: Wet Oven Blue $\Delta D_{min}$ | Dark Fade: Wet Oven Green $\Delta D_{max}$ | Dark Fade: Dry Oven Blue $\Delta D_{min}$ | Dark Fade: Dry Oven Green $\Delta D_{max}$ | Light Fade Blue $\Delta D_{min}$ | Light Fade Green $\Delta D_{max}$ |
|---|---|---|---|---|---|---|---|---|
| Test A | | | | | | | | |
| 1 mole | 1 (517) | TCP** | +.27 | −.02 | +.08 | −.12 | +.23 | −.41 |
| chromanol | 1 (517) | Cmpd. 2 | +.05 | −.03 | +.04 | −.05 | +.12 | −.42 |
| stabilizer A | 2 (452) | TCP** | +.23 | −.03 | +.10 | −.14 | +.25 | −.50 |
| per mole | 2 (452) | Cmpd. 2 | +.03 | −.06 | +.04 | −.02 | +.09 | −.51 |
| of coupler | 1 (517) | TCP** | +.20 | +.01 | +.09 | −.09 | +.19 | −.40 |
| | 1 (517) | Control 1 | +.19 | +.03 | +.09 | −.08 | +.15 | −.39 |
| | 1 (517) | Control 2 | +.18 | +.02 | +.08 | −.07 | +.13 | −.30 |

TABLE 1-continued

| | Magenta Coupler (mg/m²) | Coupler Solvent* | Dark Fade Wet Oven Blue $\Delta D_{min}$ | Dark Fade Wet Oven Green $\Delta D_{max}$ | Dark Fade Dry Oven Blue $\Delta D_{min}$ | Dark Fade Dry Oven Green $\Delta D_{max}$ | Light Fade Blue $\Delta D_{min}$ | Light Fade Green $\Delta D_{max}$ |
|---|---|---|---|---|---|---|---|---|
| | 1 (517) | Control 3 | +.17 | +.06 | +.07 | −.04 | +.08 | −.31 |
| Test B | | | | | | | | |
| 2 moles | 1 (517) | DBP*** | +.26 | +.02 | +.09 | −.13 | +.16 | −.28 |
| chromanol | 1 (517) | Cmpd. 39 | +.09 | −.02 | +.07 | −.07 | +.08 | −.37 |
| stabilizer B | 1 (517) | Cmpd. 9 | +.09 | 0 | +.08 | −.10 | +.07 | −.29 |
| per mole | 2 (560) | DBP*** | +.23 | −.03 | +.12 | −.13 | +.17 | −.34 |
| of coupler | 2 (560) | Cmpd. 39 | +.09 | +.01 | +.07 | −.04 | +.11 | −.42 |
| | 2 (560) | Cmpd. 9 | +.10 | +.02 | +.09 | −.04 | +.08 | −.34 |
| | 1 (517) | DBP*** | +.28 | +.01 | +.08 | −.15 | +.10 | −.25 |
| | 1 (517) | Cmpd. 2 | +.08 | 0 | +.04 | −.08 | +.05 | −.31 |
| | 1 (517) | Control 4 | +.23 | +.03 | +.11 | −.14 | +.13 | −.27 |
| | 2 (560) | DBP*** | +.29 | +.01 | +.09 | −.15 | +.18 | −.31 |
| | 2 (560) | Control 4 | +.21 | +.03 | +.11 | −.12 | +.14 | −.30 |
| Test C | | | | | | | | |
| No | 3 (474) | DBP*** | +.12 | 0 | +.10 | +.01 | +.01 | −.89**** |
| chromanol | 3 (474) | Cmpd. 2 | +.05 | −.21 | +.04 | −.13 | +.01 | −.67**** |
| stabilizer | 4 (344) | TCP** | +.23 | −.04 | +.22 | −.05 | +.57 | −.89 |
| | 4 (344) | Cmpd. 2 | +.07 | −.14 | +.07 | −.13 | +.15 | −.90 |

*coated at ½ weight of coupler
**tricresyl phosphate
***dibutyl phthalate
****these values for 6 weeks exposure It can be seen from magenta layer data in Table 1 that the coupler solvents of the invention are markedly better than either conventional solvents or comparative epoxy coupler solvents in preventing yellow stain formation on high humidity keeping (wet oven). Advantages in limiting stain on exposure to heat (dry oven) or light (light fade) are also noted, especially for compound 2, while control 4 usually increases stain. Resistance to heat fading (dry oven) of the magenta image is also improved by the use of the inventive solvents when the usual stabilizers are present, while fading by humidity (wet oven) and light (light fade) are less affected. Even in the absence of stabilizer, compound 2 shows an improvement in light fading for the dye from coupler 3.

COUPLERS

COUPLER 1

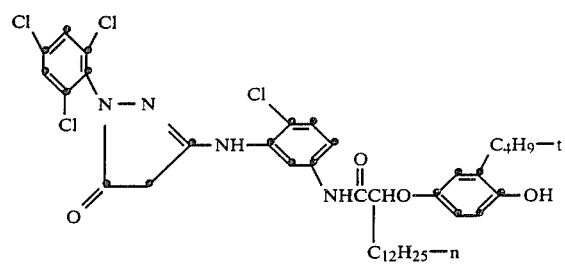

COUPLER 2

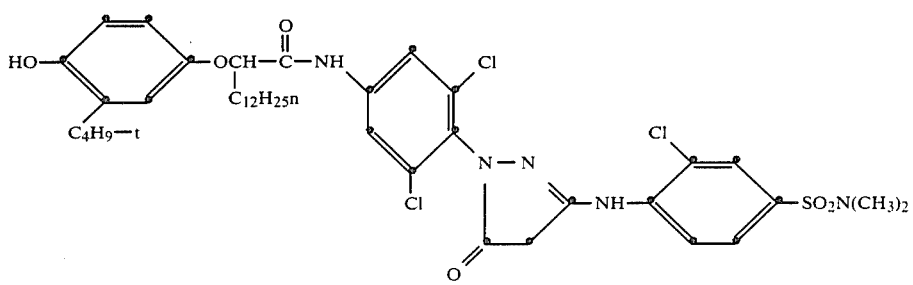

COUPLER 3

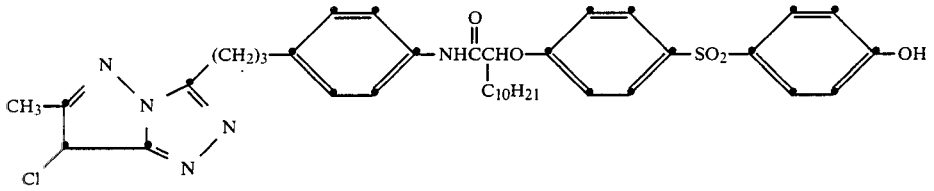

Control 4

COUPLER 4

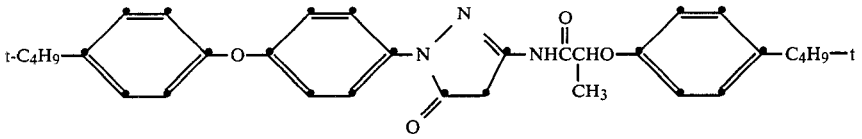

(U.S. Pat. No. 4,239,851 Compound 14)

COMPARATIVE COUPLER SOLVENTS

Control 1

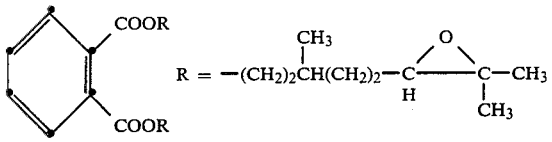

Control 2

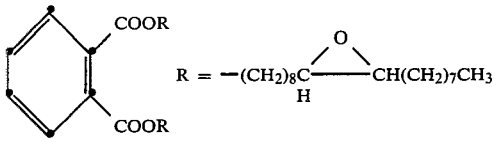

Control 3

(U.S. Pat. No. 4,239,851 Compound 3)

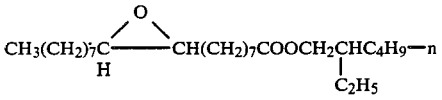

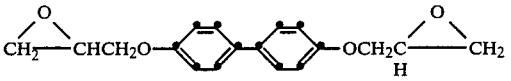

| Chromanol Stabilizers | | R |
|---|---|---|
| A | 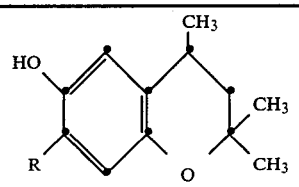 | t-$C_8H_{17}$ |
| B | 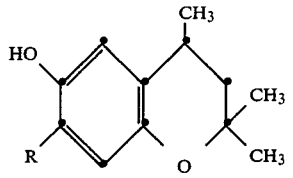 | n-$C_8H_{17}$ |

EXAMPLE 7

Yellow and Cyan Monolayer Photographic Testing

Coating, processing and testing were carried out as in Example 6 except that yellow and cyan couplers were dispersed without stabilizers and lower levels of silver were employed as noted in Tables 2 and 3. Measurements were made of increases in yellow stain ($\Delta D_{min}$ to blue light) and of changes in a D=1.0 patch for yellow ($\Delta D_{max}$ to blue light) in Table 2 and for cyan ($\Delta D_{max}$ to red light) in Table 3. The following results were obtained:

TABLE 2

| | Yellow | | Dark Fade | | | | Light Fade | |
|---|---|---|---|---|---|---|---|---|
| | | | Wet Oven | | Dry Oven | | | |
| | Coupler (mg/m$^2$) | Coupler Solvent* | Blue $\Delta D_{min}$ | Blue $\Delta D_{max}$ | Blue $\Delta D_{min}$ | Blue $\Delta D_{max}$ | Blue $\Delta D_{min}$ | Blue $\Delta D_{max}$ |
| silver level at | 5 (980) | DBP** | +.03 | −.02 | +.02 | +.01 | −.03 | −.11 |
| 3.75 mmoles/m$^2$ | 5 (980) | Cmpd. 2 | +.03 | 0 | +.02 | −.01 | −.02 | −.11 |

*coated at ½ weight of coupler
**dibutyl phthalate

TABLE 3

| | Cyan Coupler (mg/m²) | Coupler Solvent* | Dark Fade Wet Oven Blue $\Delta D_{min}$ | Dark Fade Wet Oven Red $\Delta D_{max}$ | Dark Fade Dry Oven Blue $\Delta D_{min}$ | Dark Fade Dry Oven Red $\Delta D_{max}$ | Light Fade Blue $\Delta D_{min}$ | Light Fade Red $\Delta D_{max}$ |
|---|---|---|---|---|---|---|---|---|
| Test A | | | | | | | | |
| silver level at | 6 (624) | DBP** | +.03 | −.23 | +.03 | −.32 | +.04 | −.14 |
| 2.59 mmoles/m² | 6 (624) | Cmpd. 2 | +.02 | −.04 | +.02 | −.20 | 0 | −.15 |
| Test B | | | | | | | | |
| silver level at | 7 (635) | DBP** | +.05 | +.02 | +.04 | −.15 | 0 | −.06 |
| 3.05 mmoles/m² | 7 (635) | Cmpd. 2 | +.02 | +.10 | +.02 | −.08 | −.01 | −.15 |

*coated at ½ weight of coupler
**dibutyl phthalate

The data in Tables 2 and 3 show that the inventive coupler solvent compound 2 can replace dibutyl phthalate without detriment in a yellow layer and can give a marked improvement in cyan dye stability to heat and, for a coupler 6 coating, to humidity. Minor improvements in yellow stain limitation for the cyan layers can also be seen under high humidity, heat, and light exposure conditions.

COUPLER 5

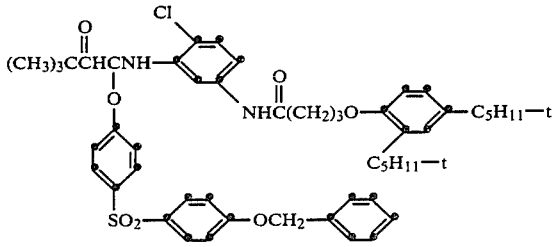

COUPLER 6

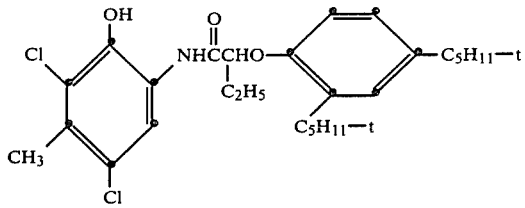

COUPLER 7

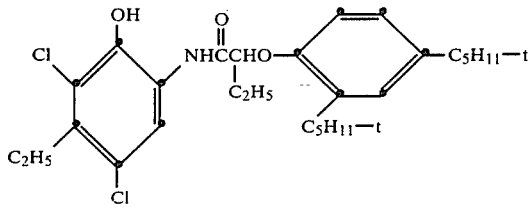

EXAMPLE 8

Magenta Image Granularity Dependence on Coupler Solvent

Stepped magenta image samples obtained in Example 6 for coatings of coupler 1 dispersed in three different coupler solvents were examined. Comments on results of the visual examination and granularity measurements are reported in Table 4. The general theory and procedure for measuring Wiener power spectra are described in Chapter 8 of *Image Science* by J. C. Dainty and R. Shaw, N.Y., Academic Press, 1974. Samples were illuminated diffusely with a Quartz-Halogen lamp (color temperature 3250° K.) and read through a 25×2500μm slit using a Wratten 61 filter and an S-4 phosphor photomultiplier tube. The measurements were adjusted for the frequency sensitivity of the human eye and compared at a density to green light of 0.115.

TABLE 4

| Coupler Solvent | Granularity | Appearance |
|---|---|---|
| compound 2 | $1.15 \times 10^{-3}$ | clean, uniform very light magenta |
| DBP | $1.65 \times 10^{-3}$ | clean, uniform very light magenta |
| control 4 | $4.30 \times 10^{-3}$ | hazy, small magenta specks |

It is apparent from these data that the undesirable roughness and haziness of images formed using the comparison epoxy coupler solvent compound 4 is evidenced by its much higher granularity than the conventional dibutyl phthalate sample or the even lower granularity sample obtained with coupler solvent compound 2 of this invention. Comparison solvent control 4 gave very viscous dispersions which tended to crystallize and led to non-uniform coatings. Coupler solvents of the invention were free of such problems.

EXAMPLE 9

Photographic Test

A photographic element was prepared by coating a paper support with a photosensitive layer containing a silver bromoiodide emulsion at 3.89 mmoles Ag/m², gelatin at 1.615 g/m², the magenta coupler, coupler solvent and chromanol stabilizer identified in Table 5 and 10% by coupler weight of diisooctylhydroquinone. The photosensitive layer was overcoated with 861 mg/m² of a mixed Tinuvin ® UV absorber and a gelatin overcoat as in Example 6.

Samples of each element were exposed and processed as in Example 6. The samples were then subjected to the same accelerated keeping tests as in Example 6. The following results were obtained:

TABLE 5

| | Coupler (mg/m²) | Coupler Solvent* | Dark Fade Wet Oven Blue $\Delta D_{min}$ | Dark Fade Wet Oven Green $\Delta D_{max}$ | Dark Fade Dry Oven Blue $\Delta D_{min}$ | Dark Fade Dry Oven Green $\Delta D_{max}$ | Light Fade**** Blue $\Delta D_{min}$ | Light Fade**** Green $\Delta D_{max}$ |
|---|---|---|---|---|---|---|---|---|
| Test A | | | | | | | | |
| 2 moles chromanol stabilizer B per mole of coupler | 1 (517) | TCP** | +.14 | −.09 | +.11 | −.11 | +.06 | −.47 |
| | 1 (517) | Cmpd. 2 | +.03 | −.08 | +.03 | −.09 | +.04 | −.51 |
| Test B | | | | | | | | |
| 2.9 moles chromanol stabilizer B per mole of coupler | 2 (388) | TCP** | +.11 | −.10 | +.09 | −.08 | +.06 | −.55 |
| | 2 (388) | Cmpd. 2 | +.07 | −.07 | +.07 | −.07 | +.02 | −.56 |
| Test C | | | | | | | | |
| 2.9 moles chromanol stabilizer C per mole of coupler | 2 (388) | DBP*** | +.27 | +.01 | +.21 | −.08 | +.10 | −.31 |
| | 2 (388) | Cmpd. 2 | +.08 | −.01 | +.05 | −.05 | +.03 | −.32 |
| Test D | | | | | | | | |
| 2.9 moles chromanol stabilizer D per mole of coupler | 2 (388) | DBP*** | +.13 | −.05 | +.09 | −.09 | +.12 | −.48 |
| | 2 (388) | Cmpd. 2 | +.08 | −.03 | +.07 | −.05 | +.07 | −.42 |

*coated at ½ weight of coupler
**tricresyl phosphate
***dibutyl phthalate
****no 2B filter was used since a UV filter layer was incorporated in each coating The results in Table 5 show that in all cases, inventive coupler solvent compound 2 is more effective than conventional coupler solvents in limiting background stain formation on extended exposure to humidity, heat, or light. In most cases, coupler solvent compound 2 also slightly decreased the Green $\Delta D_{max}$. With conventional coupler solvents, the choice of stabilizer can give wide variations in stain formation, while with coupler solvent compound 2, various stabilizers can be used advantageously with minimal stain.

| Chromanol Stabilizer | | R | R' |
|---|---|---|---|
| B | | (See Example 6) | |
| C | 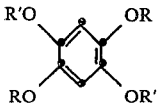 | $-CH_2CH_2OH$ | $-C_{10}H_{12}-n$ |
| D | 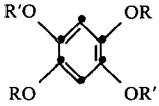 | $-CH_3$ | $-CH_2CH(C_2H_5)C_4H_9-n$ |

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer having associated therewith a dye-forming coupler dispersed in a nonpolymeric coupler solvent therefor which has at least one terminal epoxy group and at least one ester or amide group.

2. The element of claim 1 wherein said coupler solvent has the formula:

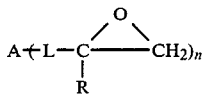

wherein

A is a polyvalent atom, an acidic oxide group, a carbocyclic group, a heterocyclic moiety, or an alkane or substituted alkane group;

each L is at least one divalent linking group;

each R is H, alkyl, cycloalkyl, aryl, heterocyclyl, $COOR^1$, wherein $R^1$ is alkyl of 1 to about 20 carbon atoms, or can be taken together with A or L to form a ring; and n is a positive integer of at least one, with the proviso that at least one A, L or R contains at least one ester or amide group derived from an acidic oxide of carbon, phosphorous, sulfur, boron or silicon.

3. The element of claim 2 wherein said dye-forming coupler forms a magenta dye upon reaction with oxidized color developing agent.

4. The element of claim 3 wherein said magenta dye-forming coupler is a pyrazolone, pyrazolotriazole, pyrazolobenzimidazole or indazolone, and said coupler and said coupler solvent are located in said silver halide emulsion layer.

5. The element of claim 2 wherein said coupler solvent has the formula:

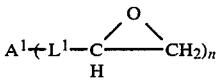

wherein $A^1$ is an alkane or substituted alkane group or a carbocyclic group, $L^1$ is a carboxylic ester and n is a positive integer of at least one.

6. The element of claim 2 wherein said polyvalent atom is oxygen, nitrogen, sulfur, boron, carbon, phosphorus or silicon; said acidic oxide group is $$-\overset{O}{\overset{\|}{C}}-,\ -\overset{O}{\overset{\|}{C}}-\overset{O}{\overset{\|}{C}}-,\ -\overset{O}{\overset{\|}{\underset{|}{P}}}-,\ -SO-,\ -SO_2-\ \text{or}\ -\overset{|}{\underset{|}{OSiO}}-$$

said carbocyclic group is benzene, naphthalene, cyclohexane, cyclopentane, cycloheptane or cyclooctane; said heterocyclic moiety is pyridine, pyridine oxide, furan, thiophene, pyrazole, triazine, quinoline, pyran,

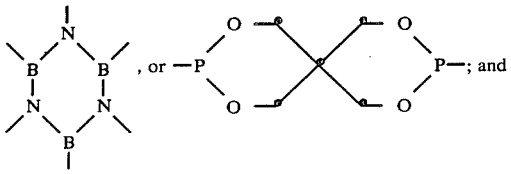

said alkane or substituted alkane group is $(CH_2)_m$ where m is 1 to about 6, $$C_4H_9\underset{\underset{C_2H_5}{|}}{CH}-CH_2-,\ CH_3CH_2\overset{|}{\underset{|}{C}}-,\ C_2H_5O\overset{O}{\overset{\|}{C}}\overset{|}{\underset{|}{CH}},\ \text{or}$$

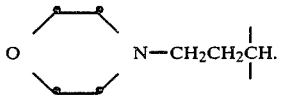

7. The element of claim 2 wherein said L is $(CH_2)_p$ where p is 1 to about 9, $$-O-,\ -NH-,\ -NH\overset{O}{\overset{\|}{C}}-NH-,\ -SO_3-,\ -\overset{O}{\overset{\|}{C}}-O-,$$

-continued

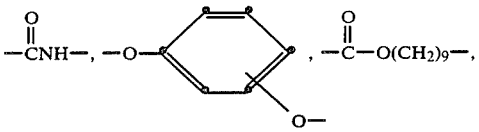

$$-\overset{O}{\overset{\|}{OC}}-(CH_2)_8-\ \text{or}\ -CH_2O\overset{O}{\overset{\|}{C}}-(CH_2)_8-.$$

8. The element of claim 2 wherein said ester or amide group is $$-\overset{O}{\overset{\|}{C}}Y-,\ -Y\overset{O}{\overset{\|}{C}}Y-,\ -Y\overset{O}{\overset{\|}{C}}\overset{O}{\overset{\|}{C}}Y-,\ -SO_2Y-,\ -YSO_2Y-,$$

$$-YSOY-,\ -\underset{\underset{Y-}{|}}{\overset{O}{\overset{\|}{P}}}-Y-,\ -\underset{\underset{Y-}{|}}{YPY}-,\ -\underset{\underset{Y-}{|}}{Y\overset{O}{\overset{\|}{P}}Y}-,\ -\underset{\underset{Y-}{|}}{YBY}-,$$

$$-\underset{\underset{Y-}{|}}{BY}-,\ -\overset{|}{\underset{|}{SiY}}-,\ -\overset{|}{\underset{|}{YSiY}}-,\ -\overset{|}{\underset{|}{YSiY}}-,$$

where Y is O or $NR^2$ and $R^2$ is hydrogen, alkyl, aryl or heterocyclyl.

9. The element of claim 5 wherein $A^1$ is a benzene ring, n is 2 and each $L^1$ is $$-\overset{O}{\overset{\|}{C}}O-(CH_2)_9-\ \text{or}\ -\overset{O}{\overset{\|}{O}}C-(CH_2)_8-.$$

10. The element of claim 5 wherein $A^1$ is a cyclohexane ring, n is 2 and each $L^1$ is $$-CH_2O\overset{O}{\overset{\|}{C}}-(CH_2)_8-.$$

11. The element of claim 5 wherein $A^1$ is $$n\text{-}C_4H_9\underset{\underset{C_2H_5}{|}}{CH}-,\ L^1\ \text{is}\ -CH_2O\overset{O}{\overset{\|}{C}}-(CH_2)_8-\ \text{and n is 1.}$$

12. The element of claim 5 wherein $A^1$ is $-CH_2CH_2-$, n is 2 and each $L^1$ is $$-\overset{O}{\overset{\|}{OC}}-(CH_2)_8-.$$

* * * * *